US009377259B2

(12) United States Patent
Milde, Jr. et al.

(10) Patent No.: US 9,377,259 B2
(45) Date of Patent: Jun. 28, 2016

(54) REMOTE CONTROL WEAPON LOCK

(71) Applicants: Karl F. Milde, Jr., Mahopac, NY (US); Jeffrey A. Matos, New Rochelle, NY (US)

(72) Inventors: Karl F. Milde, Jr., Mahopac, NY (US); Jeffrey A. Matos, New Rochelle, NY (US)

( * ) Notice: Subject to any disclaimer, the term of this patent is extended or adjusted under 35 U.S.C. 154(b) by 0 days.

(21) Appl. No.: 14/542,889

(22) Filed: Nov. 17, 2014

(65) Prior Publication Data

US 2015/0068093 A1 Mar. 12, 2015

Related U.S. Application Data

(60) Continuation-in-part of application No. 14/511,222, filed on Oct. 10, 2014, now Pat. No. 9,222,740, which is a division of application No. 13/763,951, filed on Feb. 11, 2013, now Pat. No. 8,893,420.

(60) Provisional application No. 61/761,270, filed on Feb. 6, 2013.

(51) Int. Cl.
*F41A 17/06* (2006.01)
*F41A 17/22* (2006.01)

(52) U.S. Cl.
CPC ..... *F41A 17/063* (2013.01); *F41A 17/066* (2013.01); *F41A 17/22* (2013.01)

(58) Field of Classification Search
CPC ..... F41A 17/066; F41A 17/06; F41A 17/063; F41A 17/22
USPC ..... 42/70.11
See application file for complete search history.

(56) References Cited

U.S. PATENT DOCUMENTS

| | | | | | |
|---|---|---|---|---|---|
| 4,354,189 | A | | 10/1982 | Lemelson | |
| 4,467,545 | A | | 8/1984 | Shaw, Jr. | |
| 4,682,435 | A | | 7/1987 | Heltzel | |
| 4,970,819 | A | | 11/1990 | Mayhak | |
| 5,062,232 | A | | 11/1991 | Eppler | |
| 5,448,847 | A | | 9/1995 | Teetzel | |
| 5,459,957 | A | * | 10/1995 | Winer | F41A 17/066 42/70.11 |
| 5,461,812 | A | | 10/1995 | Bennett | |
| 5,502,915 | A | | 4/1996 | Mendelsohn et al. | |
| 5,570,528 | A | | 11/1996 | Teetzel | |
| 5,603,180 | A | | 2/1997 | Houze | |
| 5,636,464 | A | | 6/1997 | Ciluffo | |
| 5,713,149 | A | | 2/1998 | Cady et al. | |
| 5,828,301 | A | * | 10/1998 | Sanchez | F41C 33/029 224/244 |
| 5,896,691 | A | | 4/1999 | Kaminski et al. | |
| 5,937,557 | A | | 8/1999 | Bowker et al. | |

(Continued)

FOREIGN PATENT DOCUMENTS

WO 2008151402 A2 12/2008

*Primary Examiner* — Stephen M Johnson
(74) *Attorney, Agent, or Firm* — Karl F. Milde, Jr.

(57) ABSTRACT

A battery-powered trigger-locking device, which is configured to be disposed on a gun with a trigger for firing, includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired. A separate electronic gun key is provided to transmit gun unlock data to the data receiver of the trigger-locking device. This gun unlock data may be a password, a long pseudo-random number or biologic data identifying the gun owner or some other person who is licensed or otherwise authorized to fire the gun.

37 Claims, 6 Drawing Sheets

(56) References Cited

U.S. PATENT DOCUMENTS

| | | | | |
|---|---|---|---|---|
| 6,293,039 | B1 | 9/2001 | Fuchs | |
| 6,314,671 | B1 | 11/2001 | Gering | |
| 6,415,542 | B1 | 7/2002 | Bates et al. | |
| 6,421,943 | B1 | 7/2002 | Caulfield et al. | |
| 6,499,243 | B1 * | 12/2002 | Herzog | F41A 17/066 42/70.06 |
| 6,711,843 | B2 | 3/2004 | Klebes | |
| 6,711,844 | B2 | 3/2004 | Rumfelt | |
| 6,763,126 | B2 | 7/2004 | Recce | |
| 6,785,995 | B2 | 9/2004 | Herzog et al. | |
| 6,823,621 | B2 * | 11/2004 | Gotfried | F41A 17/066 42/70.01 |
| 6,861,944 | B1 | 3/2005 | Hoepelman | |
| 7,030,729 | B2 | 4/2006 | Albanesi et al. | |
| 7,339,456 | B1 | 3/2008 | Buckley et al. | |
| 7,353,632 | B2 | 4/2008 | Newkirk et al. | |
| 7,356,959 | B2 | 4/2008 | Schmitter et al. | |
| 8,205,372 | B2 | 6/2012 | Anzeloni | |
| 2001/0032405 | A1 | 10/2001 | Kaminski | |
| 2001/0042332 | A1 | 11/2001 | Gering et al. | |
| 2002/0157296 | A1 | 10/2002 | Vivian et al. | |
| 2002/0174587 | A1 | 11/2002 | Rumfelt | |
| 2004/0244253 | A1 | 12/2004 | Glock | |
| 2007/0074438 | A1 | 4/2007 | Parhofer et al. | |
| 2007/0241010 | A1 * | 10/2007 | Giebel | A47B 81/00 206/317 |
| 2008/0039962 | A1 | 2/2008 | McRae | |
| 2008/0134556 | A1 | 6/2008 | Remelin | |
| 2008/0244699 | A1 | 10/2008 | Parhofer et al. | |
| 2009/0223104 | A1 | 9/2009 | Anzeloni | |
| 2011/0056108 | A1 * | 3/2011 | McCord | F41A 17/066 42/70.01 |
| 2011/0061280 | A1 | 3/2011 | Emde et al. | |
| 2011/0173869 | A1 | 7/2011 | Uhm | |
| 2012/0151814 | A1 | 6/2012 | Dietel | |
| 2012/0180357 | A1 | 7/2012 | Dietel et al. | |
| 2013/0125441 | A1 | 5/2013 | Westwood et al. | |
| 2013/0312306 | A1 | 11/2013 | Ruffin | |
| 2014/0215885 | A1 | 8/2014 | Sullivan et al. | |
| 2014/0230301 | A1 | 8/2014 | Chance et al. | |

* cited by examiner

REMOTE CONTROL WEAPON LOCK

CROSS-REFERENCE TO RELATED APPLICATIONS

This application is a continuation-in-part of U.S. application Ser No. 14/511,222 filed Oct. 14, 2014, now U.S. Pat. No. 9,222,740; said U.S. application Ser. No. 14/511,222 being a divisional of U.S. application Ser. No. 13/763,951, filed Feb. 11, 2013, now U.S. Pat. No. 8,893,420; said U.S. application Ser. No. 13/763,951 claiming priority from Provisional Application No. 61/761,270 filed Feb. 6, 2013.

BACKGROUND OF THE INVENTION

The present indention relates to a weapon lock, such as, for example, a gun look for a trigger-operated gun which is designed to be installed on the gun in a position behind the trigger to prevent the trigger from firing the gun.

Mechanical gun looks are designed to be installed on the gun in a position behind the trigger to prevent the trigger from firing the gun. These gun locks use a mechanical key that can be easily duplicated, and the locks themselves can be compromised by means of a master key or a lock pick.

Furthermore, such gun locks can be opened by anyone in possession of one of the keys. With such gun locks it is not possible to restrict the use of the gun to the gun owner or to soma other person who is licensed or otherwise authorized to use the gun.

SUMMARY OF THE INVENTION

It is a principal object of the present invention to provide a gun lock for a trigger-operated gun, which is difficult to compromise and allows only the gun owner, or some other person who is licensed or otherwise authorized to use the gun.

This object, as well as other objects which will become apparent from the discussion that follows, is achieved, in accordance with the present invention, by providing a battery-powered trigger-looking device which is configured to be disposed on a gun of the type having a trigger for firing. The trigger-locking device includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired.

According to a preferred embodiment of the invention, the gun lock device according to the invention further comprises an electronic gun key having a data transmitter for transmitting gun unlock data to the data receiver of the trigger-locking device. This gun unlock data may be a password, a long pseudo-random (and therefore hack-resistant) number or biologic data identifying the gun owner or some other person who is licensed or otherwise authorized to use the gun.

More particularly, the trigger-locking device includes:

(a) a stationary member configured to be permanently installed on the gun in a position behind the trigger; (b) a movable member, movably connected to the stationary member and movable between a locked first position which prevents the trigger from firing the gun and an unlocked second position which enables firing; (c) electromechanical apparatus disposed on the stationary member for moving the movable member between the first position and the second position in response to at least one electric signal; (d) a data receiver for receiving a gun unlock signal with gun unlock data; (e) a data memory for storing data; and (f) a first logic device, coupled to the data receiver and to the data memory, for comparing the gun unlock data received by the receiver with data stored in the memory upon receipt of the gun unlock signal, and for producing the at least one electric signal to actuate the electromechanical apparatus in dependence upon whether the stored data and the received data are substantially the same.

The first logic device is operative in this trigger-locking device to cause the electromechanical apparatus to:

move the movable member to the second position when the gun unlock data received by the receiver is substantially the same as the data stored in the memory, and maintain the movable member in the first position at all other times, thereby to prevent unauthorized operation of the gun.

The data receiver is further operative to receive a gun lock signal, and the first logic device, upon receipt of the gun look signal, is operative to cause the electromagnetic apparatus to move the movable member to the first (locked) position.

The first logic device, upon producing the electric signal, may cause the electromagnetic apparatus to move the movable member to the second position for a first duration of time, and thereafter to move the movable member back to the first position. The first duration of time is preferably selected from the group consisting of;

(i) less than 1 minute;

(ii) a range of time from 1 minute to 5 minutes;

(iii) a range of time from more than 5 minutes to 30 minutes; and (iv) more than 30 minutes, In an alternative embodiment of the invention, the movable member, after being moved to the second/unlocked position remains in that position until a gun look signal is received by the data receiver.

A gun key device has a data transmitter for transmitting gun unlock data to the data receiver in the trigger-locking device. As mentioned above, the gun unlock data may include a password, a pseudo-random number or data identifying a putative authorized person who wishes to use the gun. The pseudo-random member is preferably generated by the gun key device when the gun is first used.

According to a preferred embodiment of the invention, the gun key device further comprises:

(a) an input device, for inputting information from a putative authorized person who wishes to unlock the gun; and (b) a second logic device, coupled to both the data transmitter and the input device, for generating gun unlock data defined by the putative authorized person and for causing the data transmitter to transmit the gun unlock data to the data receiver. The putative authorized person is recognized as an authorized person if the gun unlock data substantially matches the stored data in the trigger lock data memory.

When a biologic identifier is used to unlock the gun lock, the data stored in the memory of the trigger lock may include at least one biologic identifier of the owner or an authorized person.

The input device of the gun key may be a camera, for example. In this case, the camera is operative to record an image of the putative authorized person as a biologic identifier, which image may be;

a facial image;

an image of an iris;

a retinal image;

a fingerprint;

a palm print; and an image of veins of a hand; The second logic device is then operative to process the image and to generate the gun unlock data therefrom.

Alternatively, the input device may be a microphone. The second logic device is then operative to process a voiceprint of the putative authorized person as a biologic-identifier and to generate the gun unlock data therefrom.

Finally, the input device may be an alphanumeric keyboard, whereby:

(i) the putative authorized person may input an alphanumeric code; and (ii) the putative authorized parson is recognized as an authorized person in the event the inputted code matches the stored data.

The trigger-looking device preferably comprises a first battery for providing power to at least one of the logic device, the data receiver and the data memory and a second battery for providing power to the electromechanical apparatus which is power thirsty compared to the electronic devices.

Preferably, an electric device is provided for selectively utilizing the still-functional battery when one of the two batteries is depleted.

Preferably also, the electromechanical apparatus is operative to move the movable member to the first position in the event of battery depletion.

Advantageously, the data memory comprises at least one write-once-only element to prevent degradation of the data stored in the memory and to prevent the data stored in the memory from being changed. The write-once-only element may be a PROM, an EPROM or an EEPROM, for example.

According to a preferred embodiment of the invention, the gun lock apparatus comprises at least one tamper detecting device, situated, in proximity to the trigger-locking device, for detecting external manipulation of at least one of (1) the logic device, the (2) electromechanical apparatus, and (3) the moveable member, This tamper detecting device preferably generates a tamper signal upon the detection of the external manipulation, which tamper signal causes the electromechanical apparatus to maintain the movable member in the first position for a second duration of time. The tamper detecting device may be a separate element or it may be implemented by the first logic device.

Advantageously, the trigger-locking device comprises a transmitting device, coupled to the tamper detecting device, for transmitting an alarm upon generation of the tamper signal.

According to still another preferred embodiment of the present invention, the data memory may be operative to store identifying information of a registration person authorized to input data to the data memory which identifies the authorized person. In this case, the first logic device is made operative to store data concerning a person authorized to use the gun, in the data memory only if the authorized person identification information is accompanied by identification of a putative registration person that substantially matches the stored registration person identification information. Also, the first logic device is made operative to change the data stored in the data memory only if the identification information is accompanied by identification of a putative registration person that substantially matches the stored registration person identification information.

Finally, according to still another preferred embodiment of the present invention, the electromechanical apparatus includes an electric motor coupled to a gear reduction mechanism for rotating a cam. The movable member of the trigger-locking device is moved by the can between the locked first position and the unlocked second position.

Alternatively, the electric motor may be a servo-motor which is coupled mechanically to the movable member to move this member back and forth between the two positions.

In yet another alternative embodiment of the invention, an electromagnetically controlled two position switching device may be used to control the position of movable member.

For a full, understanding of the present invention, reference should now be made to the following detailed description of the preferred embodiments of the invention as illustrated in the accompanying drawings.

BRIEF DESCRIPTION OF THE DRAWINGS

FIG. 5, comprising

DETAILED DESCRIPTION OF THE PREFERRED EMBODIMENTS

Figure 1:
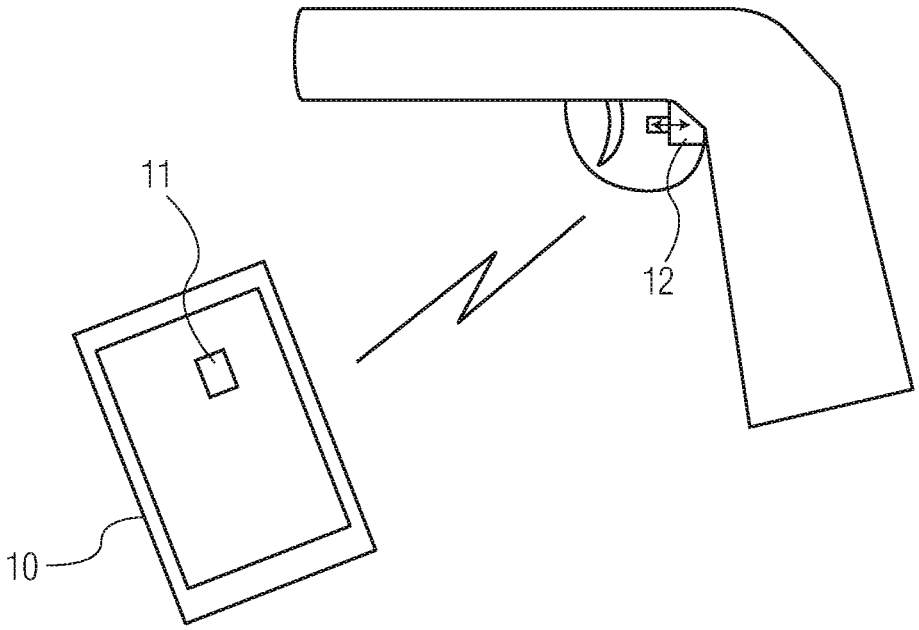
FIG. 1 is a representational diagram showing a smartphone and a gun that is equipped with a gun look according to the present invention.

The preferred embodiments of the present invention will now be described with reference to FIGS. 1-5 of the drawings. Identical elements in the various figures are identified with the same reference numerals.

Briefly in overview, a battery-operated trigger-locking device is permanently attached to/installed in a gun in a recess behind the trigger in the lower receiver mechanism, in its default condition, a movable member is in a forward position, blocking rearward movement of the trigger. When unlocked, the movable member is drawn rearward to allow movement of the trigger.

The trigger-locking device has a Bluetooth (or other type) receiver and a stored number. When this particular number is received from a smartphone or similar device, the trigger-locking device moves the movable member rearward releasing the trigger.

FIG. 1 illustrates this configuration, & smartphone 10 has an App 11 called "Gunlock" that presents a separate button called "Gun Unlock" for each gun the smartphone owner owns or is licensed to use. By pressing the button on the App, the owner sends a password, a pseudo-random number or biologic ID data by a Bluetooth wireless connection to a trigger-locking device 12 installed permanently in a gun, e.g. by a strong adhesive.

Figure 2:
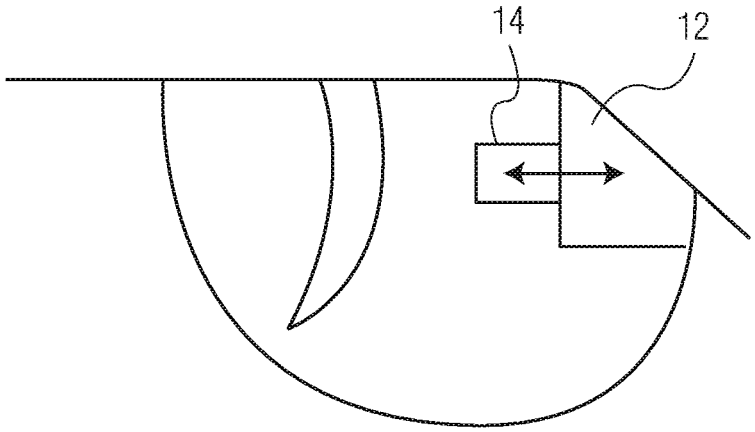
FIG. 2 is a close-up view of the trigger region of the gun of FIG. 1 with the gun lock installed.

FIG. 2 shows the trigger-locking device 12 with a movable member 14. When the device receives a data packet that matches the corresponding data stored in its memory, it draws the movable member 14 back, allowing the trigger to fire the weapon.

The smartphone can be made secure in any number of ways. It can be password protected or, preferably, it can use of its camera to verify the ID of the person holding this device. For example, the security app may use face recognition or iris recognition software to identify the owner from the camera image.

When the trigger lock 12 is first used, the Gunlock App can generate a pseudo-random number and send it to the trigger-locking device for storage in its permanent memory. Once stored, this number can be changed only by an authorized person, such as the gun owner, or a "registration person" that is duly licensed to perform this function, e.g. by a local or national government. Thereafter, whenever the smartphone sends this number again, the trigger-locking device releases the trigger so the gun may be fired. Before sending the unlock number, the user of the smartphone may be required to identify himself/herself by entering biologic identifying information into the phone for a recognition algorithm. Alternatively, the biologic ID information may be sent to the trigger-locking device for matching with corresponding biologic identifying data stored therein. In this case, the biologic identifying data, rather than an unlock number must be originally sent and stored in the data memory.

Firing the gun is therefore a two-step process for the gun owner or authorized user;

(1) Verify his/her identity with the smartphone; and (2) Press the Gun Unlock button to enable the trigger lock to release the trigger.

The trigger remains unlocked until the gun user presses another button on the Gunlock app, appropriately called "Gun Lock," or until the trigger lock times out and automatically locks itself by restoring the movable member to the locked position.

The trigger-locking device 12 is preferably powered by a replaceable and/or rechargeable battery (not shown).

Figure 3:
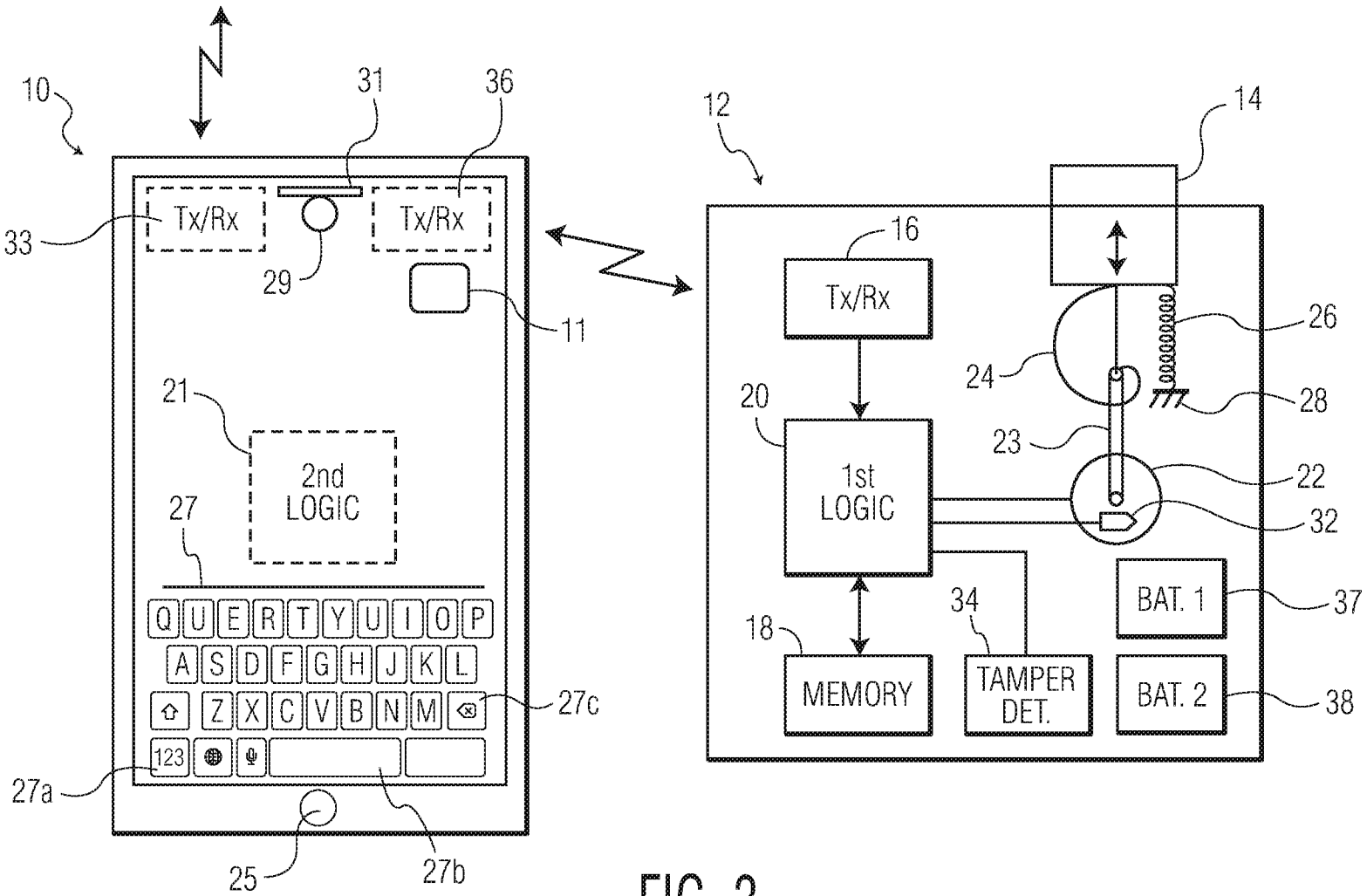
FIG. 3 is a block diagram showing a preferred embodiment of the gun lock apparatus according to the present invention.

FIG. 3 shows the individual elements of the electronic gun "key" in the gun lock apparatus according to the invention. The smartphone 10 has a transmitter/receiver 36 which communicates with a transmitter/receiver 16 in the trigger-locking device 12, preferably via a wireless bluetooth connection, Alternatively, the smartphone may be coupled to the transmitter/receiver 16 by a wire connection, for example through a USB port. The transmitter/receiver 16 and a data memory 18 are both coupled to a first logic device 20 that compares the data received from both the transmitter/receiver 16 and the memory 18 and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone is indeed the owner of the gun.

The electromechanical device is preferably a micro-motor 22 that turns a shaft 23 through a speed reduction gear mechanism. In this way, a very small motor may generate sufficient torque to move the movable member 14 between a looked position, adjacent the gun trigger, and an unlocked position which permits the trigger to fire the gun. The relatively large forces that may toe applied against the movable member by the trigger when in the locked position are taken up by a rotatable cam 24, that presses against, the movable member against the force of a spring 28. The spring 28, which is connected to a stationary member attached to the gun, biases the movable member 14 toward the unlocked position. The cam 24 abuts a cam surface on the underside of the movable member 14 and, as it rotates, it moves the movable member toward the locked position adjacent the trigger.

Figure 4:
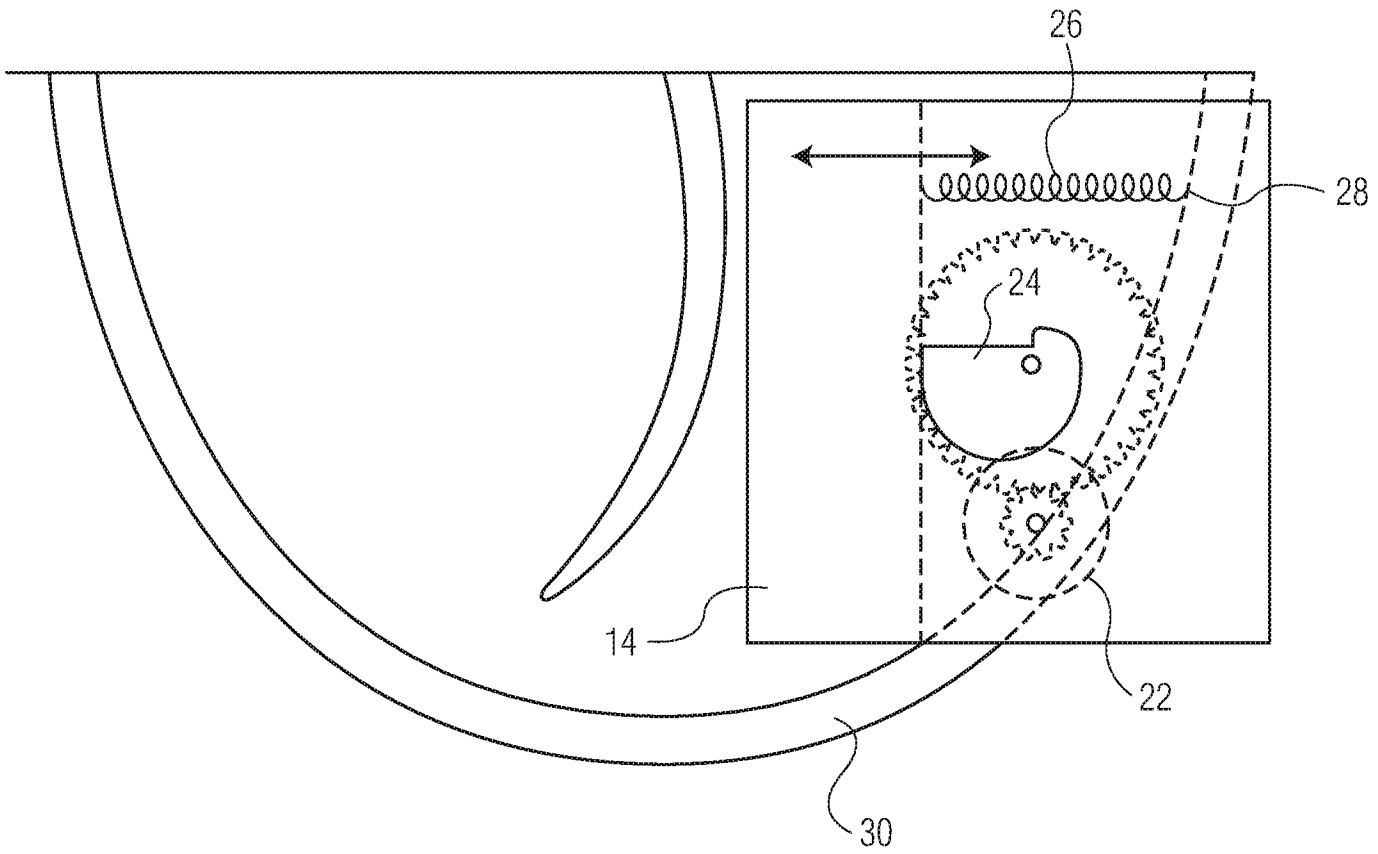
FIG. 4 is a detailed, representational diagram showing a preferred embodiment of the trigger-looking device of the present invention.

FIG. 4 illustrates this electromechanical mechanism in greater detail. The cam 24 is arranged on the reduction gear 23 which is driven by a small gear on the shaft of the motor 22. The spring 26, which is attached at 28 to the trigger guard 30, biases the moveable member in the unlocked position. The cam presses against a flat surface 32 on the inside of the moveable member 14 to move the member 14 to the locked position.

Alternatively, a servo-motor can be substituted for the motor and cam mechanism to move the movable member 14.

As is well known, the smartphone 10 ordinarily includes the following elements:

1. A second logic device 21 which operates pursuant one or more apps 11 to carry out the selected functions of the instrument;
2. A fingerprint sensor 25;
3. A alpha keypad 27 including a button 27*a* for converting the keypad to a numeric keypad, a spacebar 27*b* and a character delete key 27*c*;
4. A camera 29;
5. A microphone 31;
6. A transmitter /receiver 33 for communicating remotely via the public cellular telephone network; and
7. A Bluetooth transmitter/receiver 36 for communicating locally; for example with the transmitter/receiver 16 of the trigger-locking device 12.

According to the invention, the trigger-locking device 12 includes a tamper detecting device 34, which may be connected to the first logic device, for example. It may also include two separate batteries, 37 and 38: one battery for providing power to the electronic devices including the transmitter/receiver 16, the data memory 18 and the first logic device 20, for example, and the other battery, for example, for providing power to the motor 22 of the electromechanical gun lock mechanism.

The trigger-locking device may also include a pyrotechnic element 32 that is ignited by a signal from the first logic device to tender the gun inoperable in the event of tampering.

The movable member 14 surrounds the trigger guard 30 of the gun in such a way as to prevent tampering, Preferably a tamper detecting device is provided which signals the logic device 20 when it detects tampering so that this device can (1) signal the motor 22 to move the movable member 14 into the locked position, and (2) sound or transmit a warning signal via the transmitter/receiver 16.

Figure 5A:
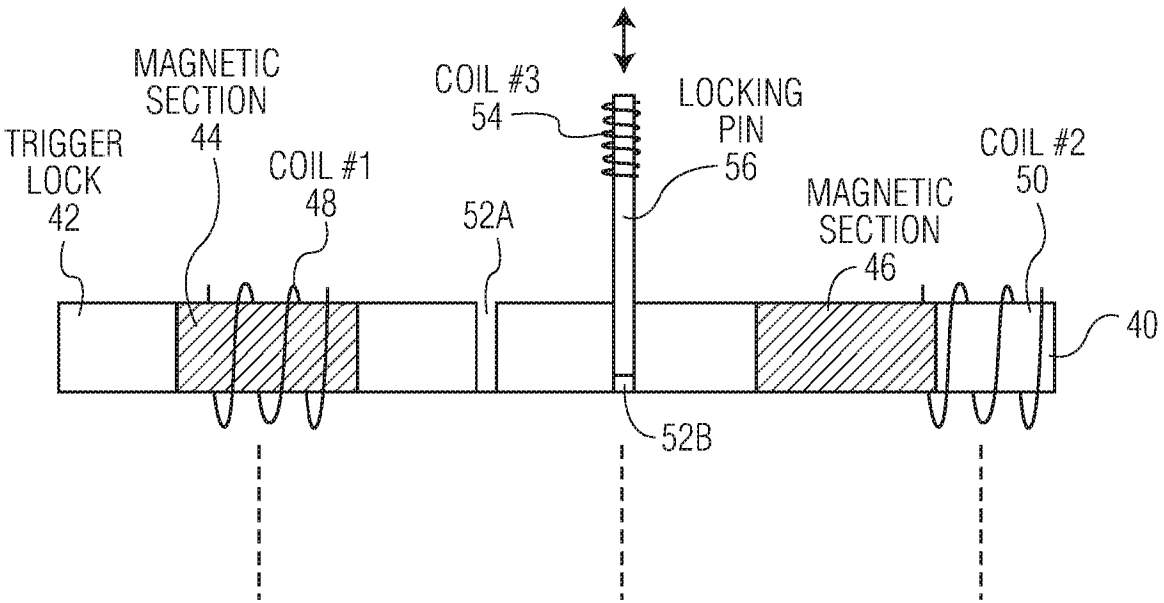
FIGS. 5A and 5B, is a representational diagram showing an alternative embodiment of the electromechanical apparatus used in the trigger-locking device.

FIG. 5 illustrates an alternative embodiment of the electromechanical apparatus for locking and unlocking the trigger-locking device. FIG. 5A shows a movable armature 40 in the locked position (i.e., moved linearly to the left in the figure). This armature presses against the moveable member 14 of the locking device, preventing actuation of the gun trigger. Sections 44 and 46 of the armature contain magnetic material that is actuated by coils 48 and 50. The armature is held in position by a locking pin 56 that is selectively pressed by a third coil 54 into receptacles or detents 52A and 52B in the armature to fix the armature in the unlocked and locked positions, respectively.

Figure 5B:
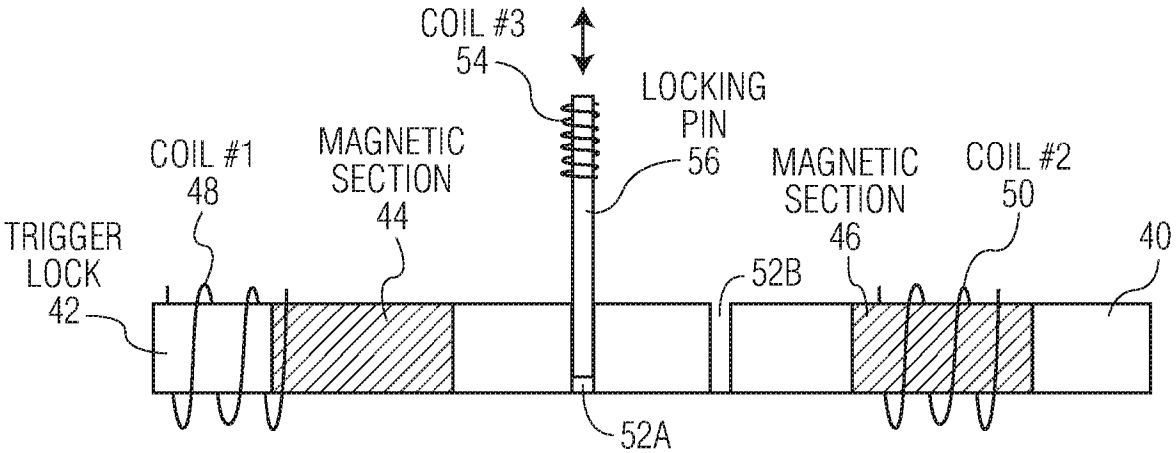

FIG. 5B shows the armature in the unlocked position (moved to the right in the figure).

There are a number of ways that a gun, or any other type of weapon, can be prevented from firing or otherwise rendered inoperative. In addition to the trigger locks described above, or in place thereof, the muzzle of a gun can be closed off by insertion of a blocking member to prevent passage of a munition projectile. Alternatively, or in addition, the weapon can be rendered inoperable by ignition of a pyrotechnic device that melts or otherwise destroys a critical part of the weapon's firing mechanism or its munition loading mechanism.

Figure 6:
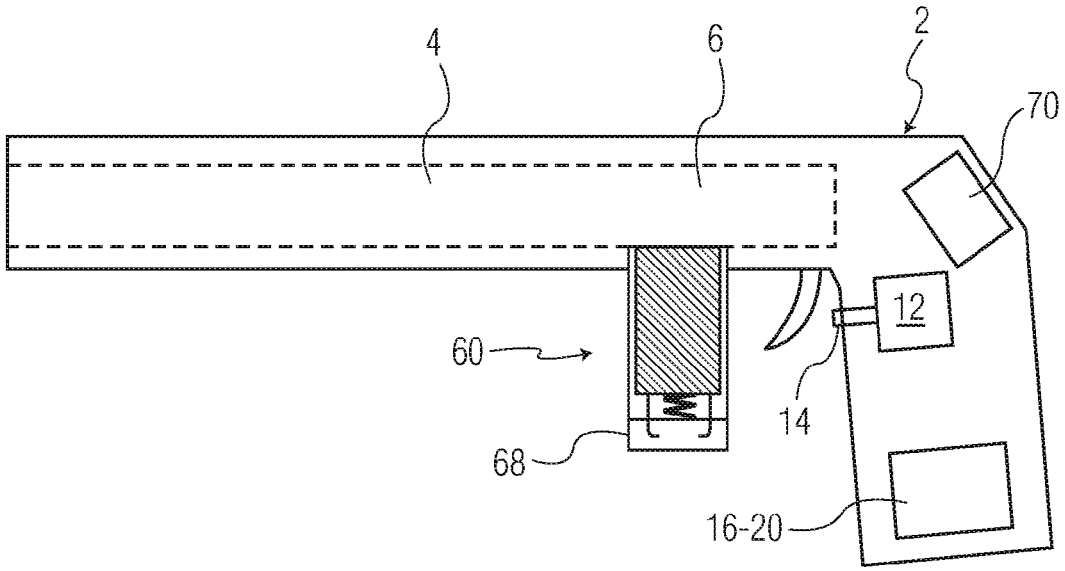
FIGS. 6 and 6A show an exemplary embodiment of a gun with a blocking device and a pyrotechnic device as alternative means for rendering the weapon inoperative.
Figure 6A:
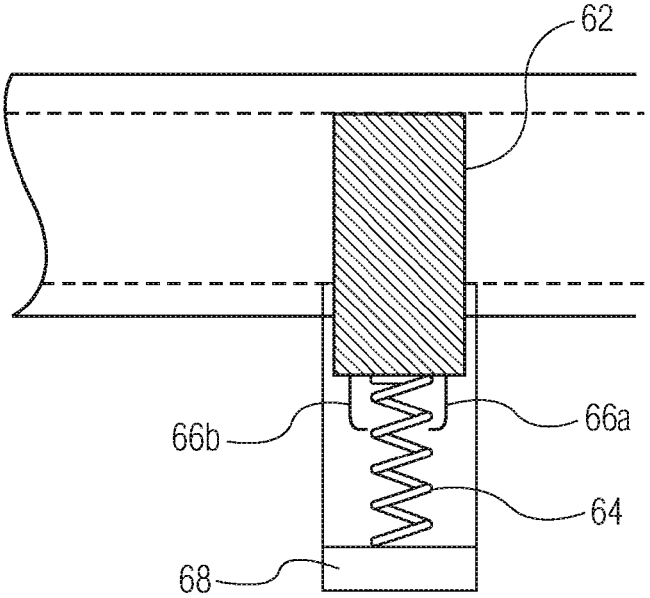

FIGS. 6 and 6A show an exemplary embodiment of a gun with both a blocking device 60 and a pyrotechnic device 70. FIG. 6 shows the unblocked configuration, and the relationship of the blocking device to the gun/weapon; FIG. 6A shows the blocked configuration, and details of device 60. The blocking device 60 comprises a blocking member 62 which is retained in the unblocked position against the force of a spring 64, displaced from the muzzle 4 of a gun 2, by means of hooks 66*a* and 66*b* that are secured by a release mechanism 68. When a gun control signal is received by the electronic system 16, 18 and 20 built into the gun, the gun security data are compared to the stored security data. If a match is found, thus validating the control signal, and if the control signal includes a "blocking" command, the hooks 66*a* and 66*b* are released by the mechanism 68 allowing the spring 64 to press the blocking member into a blocking position (FIG. 6A) of the gun muzzle 4. If the gun is of a breech loading type, the blocking member may be inserted directly into the rear chamber 6; In an alternate embodiment of the invention it may be inserted just ahead of the projectile chamber 6 to block the path of a projectile.

Upon receipt and validation of control signal with an "unblock" command, the blocking member can be manually reset to its original, unblocked position so that the gun is again ready for use.

The pyrotechnic device 70 is operative to permanently disable the gun 2. When it receives a validated command from the electronic system 16-20, it ignites and either explodes or generates sufficient heat to soften or melt critical parts of the gun mechanism to render them inoperative.

In another embodiment of the invention involving breech loading gun configurations, one or more looking devices may be utilized to prevent (or allow) the insertion of a munition into the barrel of the gun. Exemplary representative diagrams of such locking arrangements are shown in FIGS. 7A, 7B and 7C.

Figure 7A:
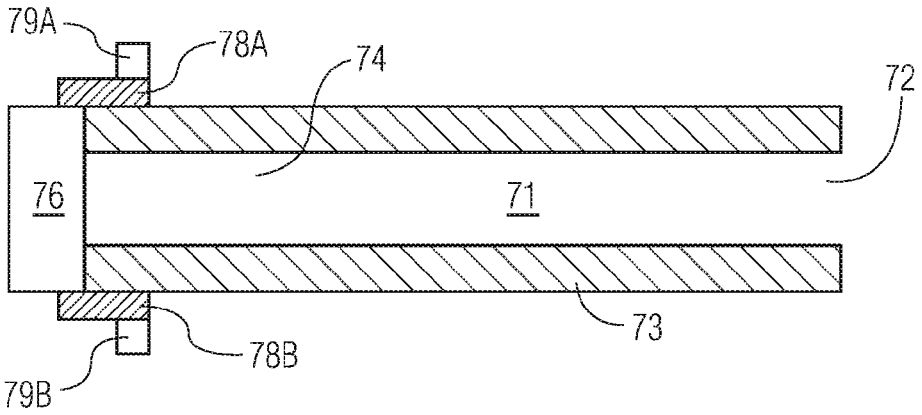
FIGS. 7A, 7B and 7C are representational diagrams showing a further exemplary embodiment of a breech-loading artillery weapon with means for blocking insertion of a munition.

FIG. 7A shows a cross sectional view of a gun 71 having a barrel 73 with a muzzle end 72 and a breech end 74. Door 76 is configured to be opened to allow for the insertion a munition such as an artillery shell. Locking apparatus 78A and/or 78B, in the locked state, prevent the opening of door 76 and thereby prevent the insertion of the shell into the breech end 74 of the barrel. In the unlocked state, 76 may be opened to permit shell insertion. Lock control devices 79A and 79B determine the state of locks 78A and 78B, respectively, in response to one or more signals indicating whether a user of the gun has been properly identified.

Figure 7B:
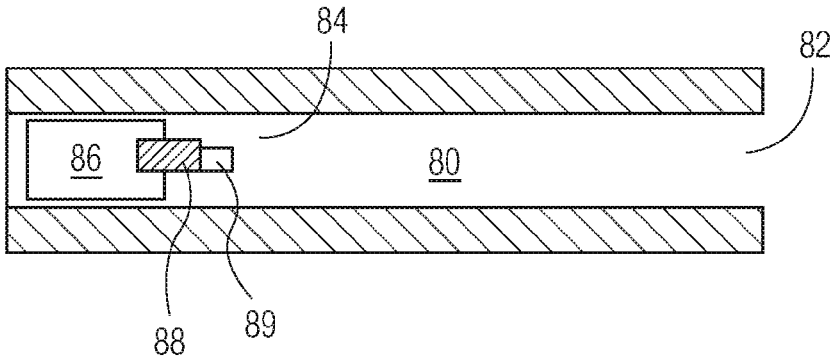

FIG. 7B shows a cross sectional view of a gun barrel 80 with a muzzle end 82 and a breech end 84. Door 86 is configured to be opened to allow for the insertion a munition such as an artillery shell. Looking apparatus 88, in the looked state, prevents the opening of door 86 and thereby prevents the insertion of the shell into the breech end, 84, of the barrel. In the unlocked state, 86 may be opened to permit shell insertion. Lock control device 89 determines the state of lock 88, in response to one or more signals indicating whether a user of the gun has been properly identified.

Figure 7C:
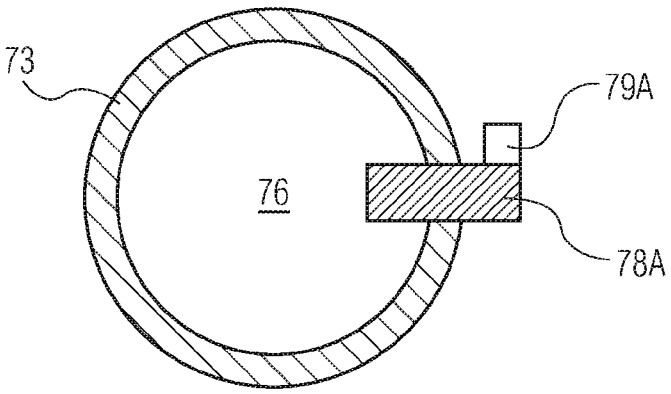

FIG. 7C shows a rear view of the breech end of a gun 90. Door 92 is configured to be opened to allow for the insertion of a munition such as an artillery shell, Locking apparatus 94, in the locked state, prevents the opening of door 92 and thereby prevents the insertion of the shell into the breech end of the barrel 90. In the unlocked state, 94 may be opened to permit shell insertion. Lock control device 96 determines the state of lock 94, in response to one or more signals indicating whether a user of the gun has been properly identified.

In each of FIGS. 7A-7C, neither (i) the number of locks, (ii) the position and orientation of the lock or looks, (iii) the spatial/geometric arrangement for introducing a shell or munition into the barrel, nor (iv) the locking mechanism, should be considered specific or limiting.

In general, depending upon the type of weapon, be it a handgun, rifle, automatic rifle or artillery weapon such as a mortar, cannon or the like, or even an grenade or bomb, and be it incendiary or a non-incendiary device that delivers a lethal or non-lethal charge, other mechanisms and configurations for rendering a weapon inoperative will occur to those skilled in the art.

Even though a weapon, such as a gun, may be provided with a remote controllable lock, a muzzle block and/or even a pyrotechnic device that can self-destroy, such safety measures would be useless if they are compromised. It is therefore recommended that the weapon also be provided with tamper resistant features such as means for detecting any attempt to block their operation. In so doing, if an unauthorized third party were to attempt to render the safety devices inoperable, the devices would enter their default "fail safe" mode, which is to lock, to block and/or to destroy the weapon.

The tamper resistant features preferably include:

(1) Frangible conductors hidden within the weapon which break a circuit and alert the logic device of an attempt to disassemble or otherwise compromise critical parts of the weapon, such as the safety devices themselves;

(2) Repeated wireless "pinging" of the weapon, the absence of which is detected to determine whether the wireless receiver of the weapon has been placed in a Faraday cage or otherwise compromised to prevent receipt of a disable signal; and (3) Detection of loss of the primary battery power to the safety devices, through the use of emergency back-up power.

Other tamper detection and tamper resistant features will occur to those skilled in the art.

There has thus been shown and described a novel secure smartphone-operated gun trigger look which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Locking apparatus for preventing use of a gun or other weapon by any unauthorized person, said apparatus comprising:

(1) a gun lock configured to be installed on a gun, said gun lock including:

(a) an electric gun lock device configured to be disposed on a gun and responsive to at least one electronic lock command signal to select among at least two operative states, including a locked state which prevents firing the gun and an unlocked state which enables firing;

(b) a data receiver for receiving a gun control signal containing first gun security data;

(c) a data memory for storing second gun security data representing biologic personal information of at least one authorized person, permitted to select said operative state;

(d) a first logic device, coupled to the data receiver and to the data memory, for (i) generating said first gun security data from said received gun control signal;

(ii)comparing said first gun security data with said second gun security data stored in said memory, and (iii) producing said at least one electronic lock command signal to select one of said operative states of said gun lock device, provided that said first gun security data and said second gun security data are substantially the same, in response to receipt of said gun control signal; and (e) at least one tamper detecting device, situated in proximity to said gun lock device, for detecting external manipulation of at least one of (1) said first logic device, and (2) said gun lock device;

wherein said tamper detecting device generates a tamper signal upon the detection of said external manipulation and wherein said tamper signal causes said gun lock device to remain in said locked state for a duration of time; and (2) a gun key device for controlling the gun lock device, said gun key device comprising:

(a) a data transmitter for transmitting said gun control signal to said data receiver;

(b) an input device for inputting personal information from a putative authorized person who wishes to control the gun; and (c) a second logic device, coupled to each of said data transmitter and said input device, for generating said gun control signal representing said first gun security data from said personal information for transmission to said data receiver;

whereby said first logic device is operative to cause said gun lock device to select one of said operative states when the first gun security data inputted by said input device are substantially the same as the second gun security data stored in said data memory; and whereby said putative authorized person is recognized as an authorized person only in the event that said first gun security data transmitted by said gun key device substantially matches said second gun security data stored in said data memory;

thereby to prevent unauthorized control of the gun.

2. The gun lock apparatus of claim 1, wherein said first gun security data generated by said second logic device and the second gun security data stored in said data memory include a pseudo-random number.

3. The gun lock apparatus of claim 1, wherein said input device include a sensor for inputting biologic personal information identifying the putative authorized person, and wherein said first gun security data generated by said second logic device includes biologic data identifying a putative authorized person who wishes to control the gun for comparison with said second gun security data stored in said data memory that includes biologic data identifying an authorized person who is permitted to control the gun.

4. The gun lock apparatus of claim 3, wherein said input device includes a camera for inputting an image of a bodily aspect of a putative authorized person and wherein biologic personal information is represented by said inputted image.

5. The gun lock apparatus of claim 4, wherein said bodily aspect of said putative authorized person is selected from the group consisting of:

a facial image;

an image of an iris;

a retinal image;

a fingerprint;

a palm print; and an image of veins of a hand;

and wherein said second logic device is operative to process said image and to generate said first gun security data therefrom.

6. The gun lock apparatus of claim 3, wherein said input device includes a microphone, and wherein said second logic device is operative to process a voiceprint of the putative authorized person as personal information and to generate said first gun security data therefrom.

7. The gun lock apparatus of claim 1, wherein said input device includes a keypad for a person to input said personal information.

8. The gun lock apparatus of claim 1, wherein said second logic device produces an electronic command signal for transmission to said data receiver which causes said gun lock device to select said unlocked state for a first duration of time and thereafter to select said locked state.

9. The gun lock apparatus of claim 5, wherein said first duration of time is selected from the group consisting of:

(i) less than 1 minute;

(ii) a range of time from 1 minute to 5 minutes;

(iii) a range of time from more than 5 minutes to 30 minutes;

(iv) more than 30 minutes;

(v) 30 minutes to 24 hours;

(vi) 1 day to 1 week; and (vi) 1 week to 1 month.

10. The gun lock apparatus of claim 1, wherein said input device includes an alphanumeric keyboard and said first and second gun security data include an alphanumeric password; wherein:

(i) said putative authorized person may input a putative alphanumeric password via said keyboard; and (ii) said putative authorized person is recognized as an authorized person only in the event said inputted putative alphanumeric password represented by said first gun security data matches an authorized alphanumeric password represented by said second gun security data.

11. The gun lock apparatus of claim 10, wherein (1) said input device is further operative to input biologic personal information identifying said putative authorized person;

(2) said second logic device is operative to cause said first gun security data to represent both (i) information representing said inputted password, and (ii) information representing said biologic personal information; and (3) said data memory is further operative to store both (i) an alphanumeric password pertaining to an authorized person and (ii) biologic information identifying said authorized person as said second gun security data;

whereby said first logic device is operative to select the unlocked state only if both the inputted biologic personal information and the inputted alphanumeric password pertaining to said putative authorized person are substantially similar to the respective stored biologic personal information and alphanumeric password pertaining to the authorized person.

12. The gun lock apparatus of claim 1, further comprising a battery for providing power to said electric gun lock device.

13. The gun lock apparatus of claim 12, wherein said electric gun lock device is further operative to select said locked state in the event of a battery depletion.

14. The gun lock apparatus of claim 1, wherein said data memory comprises at least one write-once-only element, thereby to prevent degradation of the data stored in said memory and to prevent the data stored in said memory from being changed.

15. The gun lock apparatus of claim 14, wherein said write-once-only element is selected from the group consisting of:

PROM;

EPROM; and

EEPROM.

16. The gun lock apparatus of claim 1, wherein said data memory further stores data identifying a registration person authorized to input said second gun security data to said data memory.

17. The gun lock apparatus of claim 16, wherein said first logic device is operative to store data in said data memory only if said data is accompanied by identification information of a putative registration person that Substantially matches said stored registration person identifying information.

18. The gun lock apparatus of claim 16, wherein said first logic device is operative to change the data stored in said data memory only if an instruction indicating said change is accompanied by identification information of a putative registration or person that substantially matches said stored registration person identifying information.

19. The gun lock apparatus defined in claim 1, wherein said gun lock device includes:

(1) a stationary member configured to be permanently installed on the gun;

(2) a movable member, movably connected to the stationary member and movable between a locked first position which prevents the gun from being fired and an unlocked second position which enables firing;

(3) electromechanical apparatus disposed on the stationary member for moving said movable member between said first position and said second position in response to said at least one electronic lock command signal, wherein said gun lock device:

(a) in said locked state, causes said electromechanical apparatus to move said movable member to said locked first position, and (b) in said unlocked state, causes said electromechanical apparatus to move said movable member to said unlocked second position.

20. The gun lock apparatus defined in claim 19, wherein said electromechanical apparatus includes an electric motor coupled to a gear reduction mechanism for rotating a cam, wherein said movable member of the gun lock device is moved by said cam between said first position and said second position.

21. The gun lock apparatus defined in claim 19, wherein said electromechanical apparatus includes a servo-motor coupled mechanically to said movable member of said gun lock device.

22. The gun lock apparatus defined in claim 19, wherein said electromechanical apparatus includes an armature which is movable between said first and second position by at least one first coil, and a locking pin which is movable by at least one second coil into and out of a locking receptacle in the armature to hold the armature in said first and second position, respectively.

23. The gun lock apparatus defined in claim 1, wherein said second gun security data are repeatedly changed to increase security.

24. The gun lock apparatus of claim 1, wherein said second logic device is further operative to produce an electronic gun command signal for transmission to said data receiver which causes said first logic device to select one of said operative states of said electric gun lock device.

25. The gun lock apparatus of claim 24, further comprising an electric gun blocking device configured to be disposed on the gun in addition to said electric gun lock device, coupled to said first logic device and responsive to at least one electronic block command signal received from said data receiver to select among two operative states, including a blocked state which prevents a munition projectile from passing through a muzzle of the gun and an unblocked state which enables a munition projectile to pass through said muzzle, and wherein said command signal includes at least one of a gun block command and an gun unblock command.

26. The gun lock apparatus of claim 24, further comprising an electric gun blocking device configured to be disposed on the gun in addition to said electric gun lock device, coupled to said first logic device and responsive to at least one electronic block command signal received from said data receiver to select among two operative states, including a blocked state which prevents a munition projectile from entering a barrel of the gun and an unblocked state which enables a munition projectile enter said muzzle, and wherein said command signal includes at least one of a gun block command and an gun unblock command.

27. The gun lock apparatus of claim 1, further comprising an electric gun damaging device configured to be disposed on the gun, coupled to said first logic device and responsive to at least one electronic damage command signal received from said data receiver to initiate a pyrotechnic device that renders the gun inoperable.

28. Gun lock apparatus for preventing use of a gun by any unauthorized person, said apparatus comprising:

(a) an electric gun locking device configured to be disposed on a gun and responsive to at least one electronic command signal to select among at least two operative states, including a locked state which prevents firing the gun and an unlocked state which enables firing;

(b) a data receiver for receiving a gun control signal containing first gun security data;

(c) a data memory for storing second gun security data; and (d) a logic device, coupled to the data receiver, to the data memory and to the gun locking device, for comparing said first gun security data received by said receiver with said second gun security data stored in said memory upon receipt of said gun control signal, and for producing said command signal to select one of said operative states of said gun lock device, provided that said first gun security data and said second gun security data are substantially the same, in response to receipt of said gun control signal;

(e) at least one tamper detecting device, coupled to said logic device, situated in proximity to said gun lock device, for detecting external manipulation of at least one of (1) said logic device, and (2) said gun lock device;

wherein said tamper detecting device generates a tamper signal upon the detection of said external manipulation and wherein said tamper signal causes said logic device to cause said gun lock device to be in said locked state; and (f) an electric gun burning device, disposed on the gun in addition to said gun locking device and responsive to at least one electronic command signal, to initiate a pyrotechnic burn that renders the gun inoperable;

whereby said logic device is operative to cause said gun lock device to select one of said operative states when the first gun security data received by said data receiver are substantially the same as the second gun security data stored in said memory; and whereby said logic device is operative to prevent the selection of the operative state, and to hold the gun lock device in the locked state, upon detection of said external manipulation.

29. The gun lock apparatus of claim 28, further comprising a transmitting device, coupled to said tamper detecting device, for transmitting an alarm upon generation of said tamper signal.

30. The gun lock apparatus of claim 28, wherein said tamper detecting device includes said logic device.

31. The gun lock apparatus defined in claim 28, wherein said first and second gun security data include a pseudo-random number.

32. The gun lock apparatus defined in claim 28, wherein said first and second gun security data include an alphanumeric password.

33. The gun lock apparatus of claim 28, wherein the second gun security data stored in said data memory include biologic data identifying an authorized person is permitted to control the gun, and the first gun security data received by said data receiver include biologic data identifying a putative authorized person who wishes to control the gun.

34. The gun lock apparatus defined in claim 28, wherein said second gun security data are repeatedly changed to increase security.

35. The gun lock apparatus of claim 28, further comprising an electric gun blocking device configured to be disposed on the gun in addition to said gun locking device and responsive to at least one electronic command signal to select among two operative states, including a blocked state which prevents a munition projectile from pasting through a muzzle of the gun and an unblocked state which enables a munition projectile to pass through said muzzle, and wherein said command signal includes a gun block command and an gun unblock command.

36. The gun lock apparatus of claim 28, wherein the at least one electronic command signal produced by said first logic device causes said gun lock device to select said unlocked state for a first duration of time and thereafter to select said locked state.

37. The gun lock apparatus of claim 36, wherein said first duration of time is selected from the group consisting of:

(i) less than 1 minute;

(ii) a range of time from 1 minute to 5 minutes;

(iii) a range of time from more than 5 minutes to 30 minutes;

(iv) more than 30 minutes;

(v) 30 minutes to 24 hours;

(vi) 1 day to 1 week; and (vi) 1 week to 1 month.

* * * * *